US012419371B2

(12) United States Patent
Javed

(10) Patent No.: US 12,419,371 B2
(45) Date of Patent: Sep. 23, 2025

(54) TOOL HOLDER HAND GARMENT

(71) Applicant: Rizwan Javed, Ajax (CA)

(72) Inventor: Rizwan Javed, Ajax (CA)

( * ) Notice: Subject to any disclaimer, the term of this patent is extended or adjusted under 35 U.S.C. 154(b) by 0 days.

(21) Appl. No.: 17/150,956

(22) Filed: Jan. 15, 2021

(65) Prior Publication Data

US 2022/0225708 A1 Jul. 21, 2022

(51) Int. Cl.
*A41D 19/00* (2006.01)
*A41D 19/015* (2006.01)

(52) U.S. Cl.
CPC ..... *A41D 19/0037* (2013.01); *A41D 19/002* (2013.01); *A41D 19/0024* (2013.01); *A41D 2600/20* (2013.01)

(58) Field of Classification Search
CPC ..... A41D 19/0037; A41D 19/0024; A41D 19/002; A41D 19/01594; A41D 19/0027; A41D 19/0031; A41D 2600/20; A41D 19/0044; A41D 19/00; A41D 19/0034; A41D 20/00
USPC ..... 2/160, 170
See application file for complete search history.

(56) References Cited

U.S. PATENT DOCUMENTS 137,988 A * 4/1873 Whipple ..... A41D 19/002 206/0.81
3,629,867 A * 12/1971 Taylor ..... B43K 23/001 2/160
5,003,637 A * 4/1991 Lonon ..... A41D 19/0024 2/160
5,276,922 A * 1/1994 Floyd, Jr. ..... B67B 7/16 2/160
5,853,210 A * 12/1998 Robinson ..... A46B 5/025 2/160
6,401,253 B2 * 6/2002 Brunson ..... A41D 19/01594 224/183
7,363,660 B1 * 4/2008 Gilliland ..... A41D 19/01594 2/163
10,575,574 B1 * 3/2020 Toledo ..... B67B 7/0411
10,806,194 B1 * 10/2020 Tyson ..... A45D 33/18
2002/0148031 A1 * 10/2002 O' Dea ..... A41D 19/01594 2/160
2007/0204419 A1 * 9/2007 Lewis ..... A41D 19/01594 2/160
2014/0165261 A1 * 6/2014 Morris ..... A41D 27/205 2/160
2014/0366244 A1 * 12/2014 Rico ..... A41D 19/0024 2/160
2018/0255848 A1 * 9/2018 Moreau ..... A41D 19/0024
(Continued)

FOREIGN PATENT DOCUMENTS

CN 109984397 A * 7/2019
DE 102004007477 A1 * 9/2005 ..... A41D 19/002
(Continued)

OTHER PUBLICATIONS

English translation of KR 20-2017-0002606 U (Year: 2017).*

*Primary Examiner* — Amy Vanatta
(74) *Attorney, Agent, or Firm* — CAPEHART LAW FIRM

(57) ABSTRACT

A tool holder; the tool holder includes garment(s) wearable on a hand and a set of tool holding-means. The set of tool holding-means are configured to attach a plurality of tools and a plurality of tool accessories to the garment(s). The tool holder is useful for providing a wearer of the garment(s) with essential tools needed for an activity or a job.

2 Claims, 7 Drawing Sheets

(56) References Cited

U.S. PATENT DOCUMENTS

| | | | | |
|---|---|---|---|---|
| 2019/0216144 | A1* | 7/2019 | York | A41D 27/085 |
| 2020/0375288 | A1* | 12/2020 | Zvak | F16B 2/24 |
| 2022/0248786 | A1* | 8/2022 | Choi | A41D 19/01594 |

FOREIGN PATENT DOCUMENTS

| | | | | |
|---|---|---|---|---|
| EP | 2361518 | A2 * | 8/2011 | A41D 19/0037 |
| KR | 2020170002606 | U * | 7/2017 | |

* cited by examiner

TOOL HOLDER HAND GARMENT

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

TECHNICAL FIELD

The present invention relates generally to the field of tool holders of existing art and more specifically relates to a tool holder garment for wear on at least one hand.

RELATED ART

Hand-held tools enhance a person's abilities, and as such, many jobs and activities require the use of hand tools and corresponding accessories. For example, construction jobs require the use of screws, drill bits, marker tools such as pencils, screwdrivers, etc. When working on these jobs or activities, it is often difficult to hold the tools and accessories needed, particularly when the workers hands are in use, such as when using drills; or when the hands are required for balance, such as when using ladders. As such, workers often place tools and accessories in their pockets, in aprons, or on nearby surfaces. However, this is not ideal as the tools and accessories are hard to reach or are easily misplaced. As such, a suitable solution is desired.

SUMMARY OF THE INVENTION

In view of the foregoing disadvantages inherent in the known tool holder art, the present disclosure provides a novel tool holder hand garment. The general purpose of the present disclosure, which will be described subsequently in greater detail, is to provide a hand garment for providing quick and easy access to tools needed to complete an activity or a job.

A tool holder is disclosed herein. The tool holder includes at least one garment being configured for wear on a hand of a user, and a cuff being configured for wear on a wrist of the user. The cuff may be attached to the garment-body. The at least one garment further may include a rear side relative to the hand of the user when worn and a palm side opposite the rear side and relative to the hand of the user when worn. A set of tool holding-means may be located about at least one of the garment-body and the cuff. The set of tool holding-means may be configured to attach a plurality of tools to said at least one of the garment-body and the cuff. The set of tool-holding means may include at least two fasteners each configured to attach at least one tool from the plurality of tools to the at least one garment.

According to another embodiment, a method of using a tool holder is also disclosed herein. The method of using a tool holder includes providing the tool holder as above; attaching the garment-body to the hand of the user and the cuff to the wrist of the user; attaching the plurality of tools to said at least one of the garment-body and the cuff via the at least two fasteners; and selectively using the plurality of tools, as desired.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a tool holder hand garment, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to a tool holder and more particularly to a tool holder hand garment as used to provide a wearer of the tool holder hand garment with easy and quick access to a plurality of tools and tool accessories needed for performing an activity or a job.

Generally, disclosed is a pair of garments including a plurality of essentials, such as would be useful for contractors and/or homeowner(s) (DIY's). For example, the pair of garments may include a pencil holder, a measuring tape, a laser measure device, a flashlight, a magnet to hold screws, screw drivers (Robertson and Philips and the like), pockets for drill bits, a holder for a knife, a pocket for pliers, a gooseneck flashlight, etc. The pair of garments may provide the wearer with essential items that people tend to forget or misplace.

The pair of garments may each include fasteners for attaching the same tools to each garment, or different tools to each garment. For example, in some embodiments, a left garment may include pockets and magnets for attaching the laser measure device, drill bits, screws, screwdrivers, and knives thereto. The right garment may include hook and loop fastener, pockets and clips for attaching pencils, laser pointer devices, tape measures and flashlights thereto.

Referring now more specifically to the drawings by numerals of reference, there is shown in FIGS. 1-6, various views of a tool holder 100.

Figure 1:
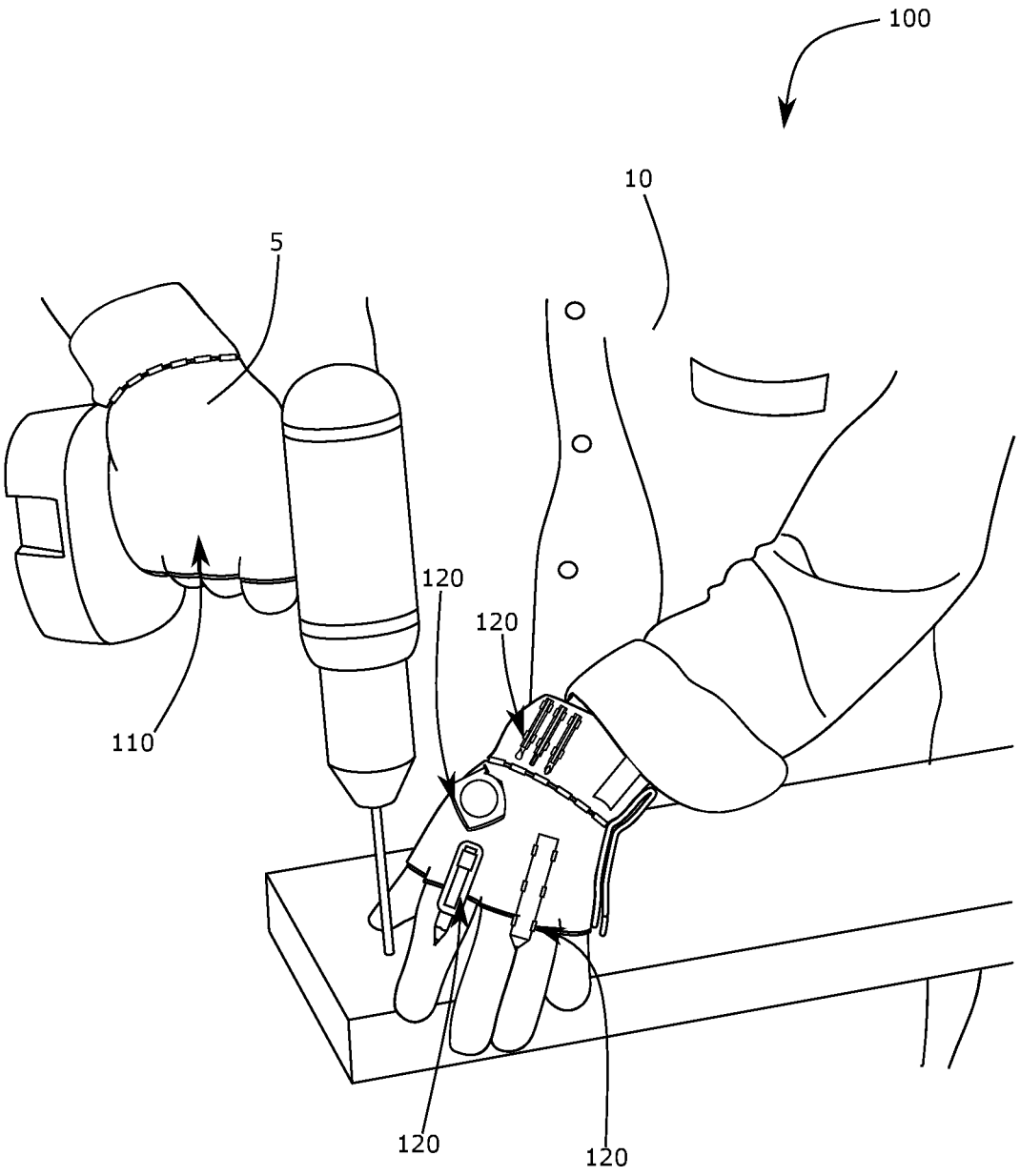
FIG. 1 is a front perspective view of the tool holder during an 'in-use' condition, according to an embodiment of the disclosure.

FIG. 1 shows a tool holder 100 during an 'in-use' condition, according to an embodiment of the present disclosure. Here, the tool holder 100 may be beneficial for use by a user 10 to provide essential tools to the user 10 when needed. As illustrated, the tool holder 100 may include at least one garment 110 and a set of tool-holding means 120. As shown, the at least one garment 110 may be configured for wear on a hand 5 of a user 10.

Referring now to FIGS. 2-6 showing various views of the tool holder 100 of FIG. 1, according to an embodiment of the present disclosure. The at least one garment 110 may include a garment-body 112 being configured for wear on a hand 5 of a user 10 and a cuff 114 being configured for wear on a wrist 15 of the user 10. The cuff 114 may include a glove-opening configured for allowing insertion of the hand 5 of the user 10 into an interior of the garment-body 112. The cuff 114 may be attached to the garment-body 112. Preferably, the cuff 114 may be pivotally-attached to the garment-body 112 to allow free movement of the wrist 15 relative to the hand 5. For example, the cuff 114 may be attached to the garment-body 112 via small hinges 109. The at least one garment 110 may be defined by a rear side 111 relative to the hand 5 of the user 10 when worn and a palm side 113 opposite the rear side 111 and relative to the hand 5 of the user 10 when worn. The at least one garment 110 may be a glove in some embodiments that is wearable over the hand 5, as any other glove. In other embodiments, the at least one garment 110 may be attachable over the hand 5. In this embodiment, the at least one garment 110 may be attached over a glove.

Further, the garment-body 112 may include a set digit-receiving sections 115. The set of digit-receiving sections 115 may include five digit-receiving sections 115: a thumb-section, an index finger-section, a middle finger-section, a ring finger-section and a little finger-section. In some embodiments, the digit-receiving sections 115 may not include sheaths for covering digits of the hand 5 of the user 10, they may instead each include apertures for insertion of the digits therethrough (rather than completely encompassing the digits). This may be particularly useful in the embodiment which allows the at least one garment 110 to attach over a glove, so as to not inhibit movement of the digits. This may also prevent premature wearing of the at least one garment 110. Further, the lack of the sheaths may allow use of a touchscreen via natural body capacitance.

Figure 2:
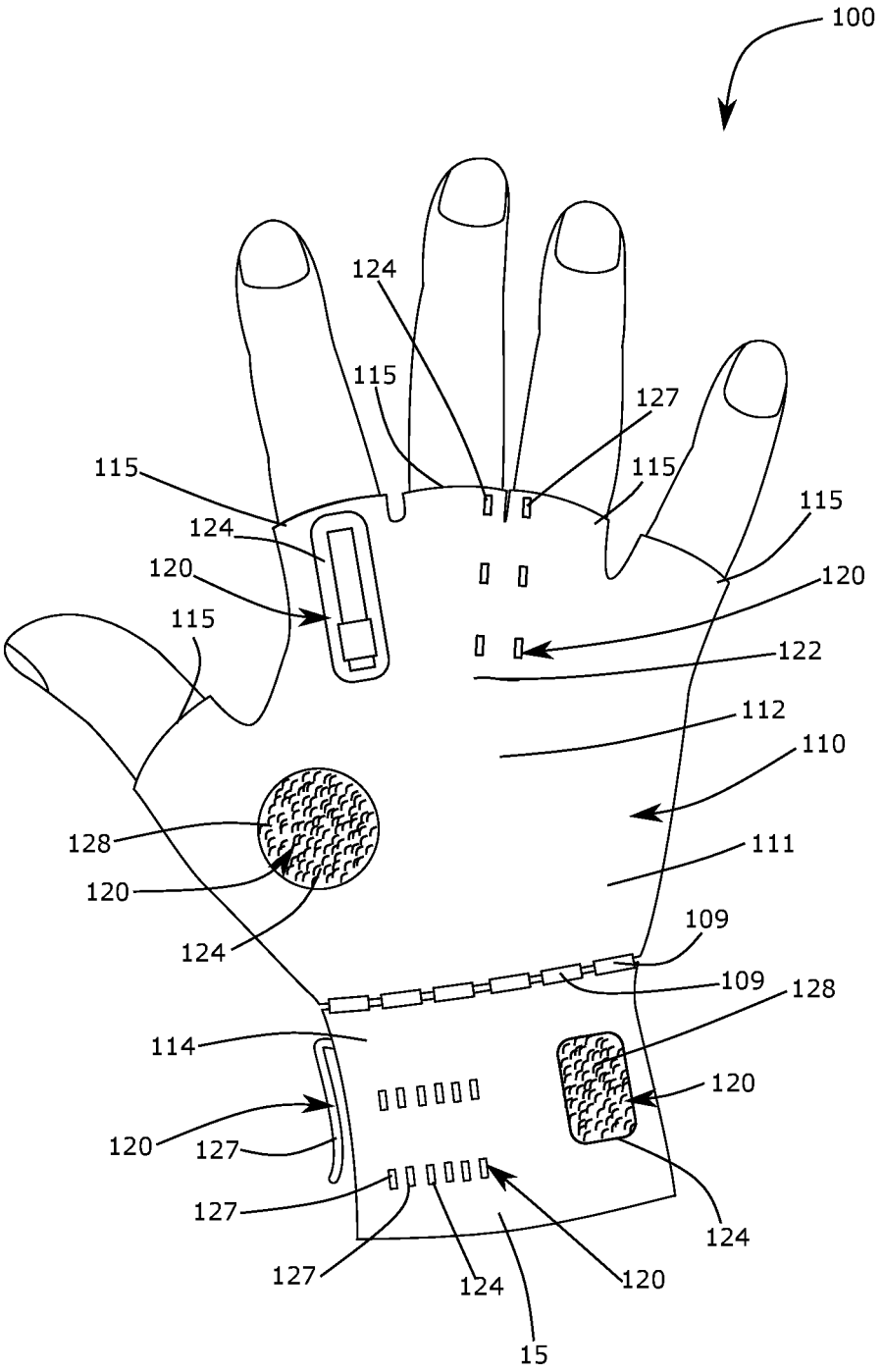
FIG. 2 is a rear perspective view of the tool holder of FIG. 1, illustrating a rear side of at least one garment being worn on a hand of a user, according to an embodiment of the present disclosure.
Figure 3:
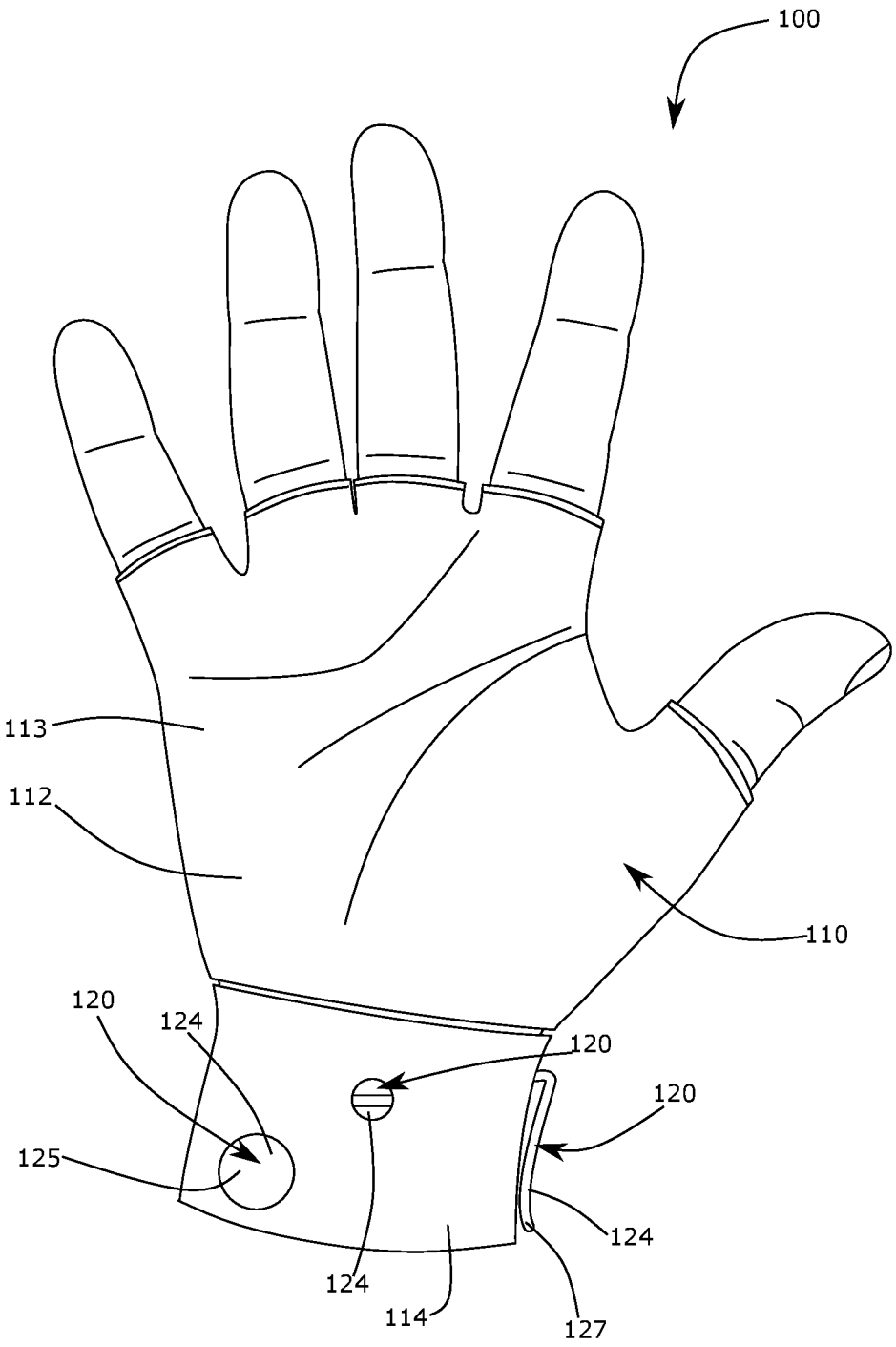
FIG. 3 is a front perspective view of the tool holder of FIG. 1, illustrating a palm side of the at least one garment being worn on the hand of the user and a plurality of tool-holding means, according to an embodiment of the present disclosure.
Figure 4:
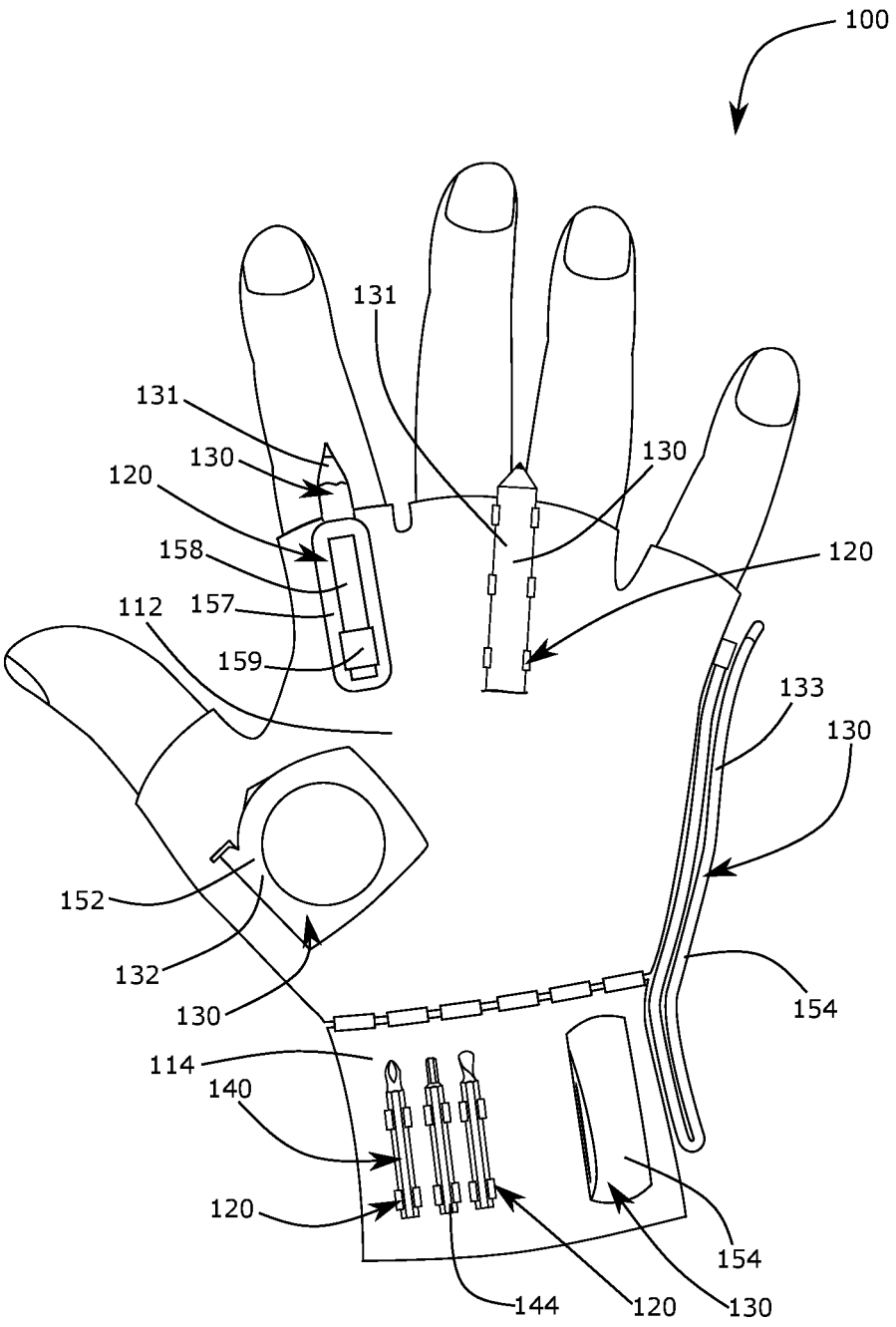
FIG. 4 is a rear perspective view of the tool holder of FIG. 1, illustrating the rear side of the at least one garment having tools and tool accessories attached thereto, according to an embodiment of the present disclosure.
Figure 5:
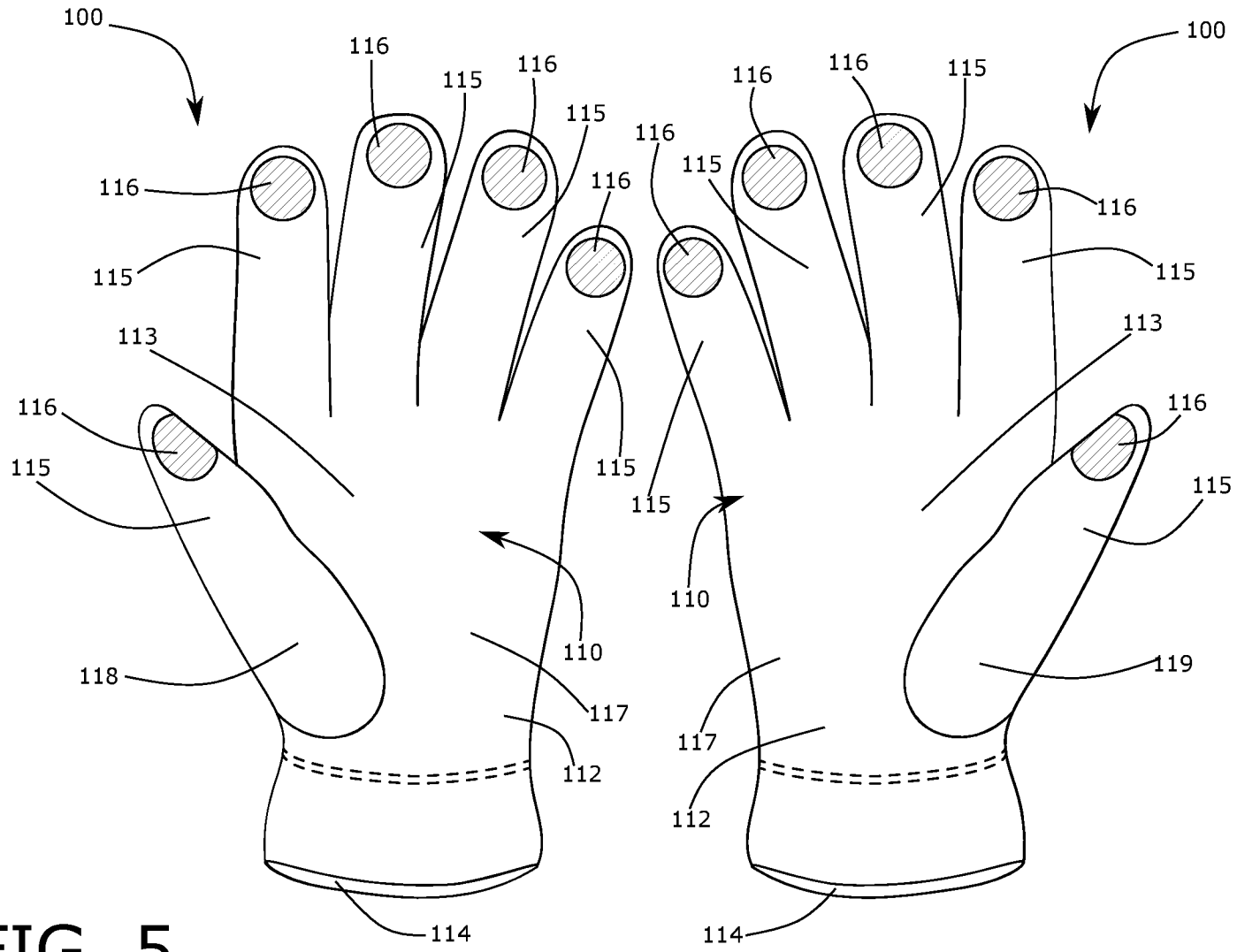
FIG. 5 is a front perspective view of the tool holder of FIG. 1, illustrating palm sides of a pair of garments and digit-receiving sections including electrically conductive material, according to another embodiment of the present disclosure.
Figure 6:
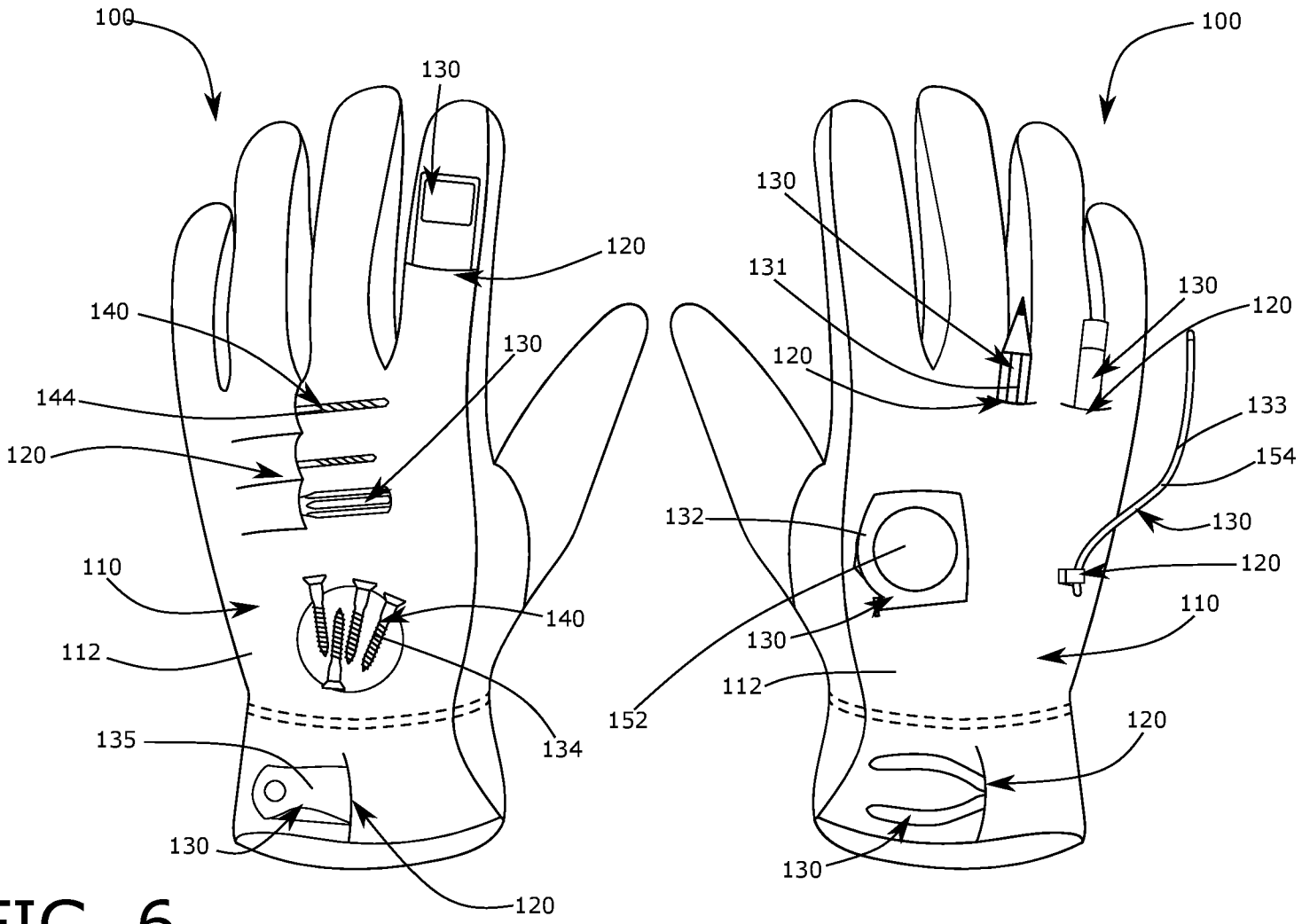
FIG. 6 is a rear perspective view of the tool holder of FIG. 1, illustrating tool and tool accessories being attached to the pair of garments via a plurality of tool-holding means, according to another embodiment of the present disclosure.

In other embodiments, particularly the glove embodiment, the set of digit-receiving sections 115 may completely encompass digits of the hand 5 of the user 10. For example, the set digit-receiving sections 115 may each include a sheath to cover the digits. In this embodiment, at least one digit-receiving section from the set of digit-receiving sections 115 may include also an electrically conductive material 116 configured for use with a touchscreen. Each of the digit-receiving sections 115 may include the electrically conductive material. The electrically conductive material 116 may be located about a pad of each digit of the user 10 to enable ease of use with the touchscreen. In FIG. 2, the electrically conductive material 116 is shown to be a patch of circular material. It should be appreciated that this is for illustrative purposes and does not limit the electrically conductive material 116 to this particular configuration.

In some embodiments, the at least one garment 110 may include a pair of garments 117. In this embodiment, the pair of garments 117 may each include a left garment 118 and a right garment 119. As shown, each of the left garment 118 and the right garment 119 may include the garment-body 112, the cuff 114, the palm side 113, the rear side 111 and, in in some embodiments, the set of digit-receiving sections 115.

The set of tool holding-means 120 may be located about at least one of the garment-body 112 and the cuff 114. The set of tool holding-means 120 may be located about the rear side 111 of the garment-body 112 so as not to obstruct or prevent use of the hand(s) 5 of the user 10. The set of tool holding-means 120 may be configured to attach a plurality of tools 130 to the garment-body 112 and/or the cuff 114. Further, preferably, the set of tool holding-means 120 may be configured to attach a plurality of tool-accessories 140 to the garment-body 112 and/or the cuff 114. In some embodiments, to ensure maximum amount of storage space is used, the garment-body 110 may be extendable.

The set of tool-holding means 120 may include at least two fasteners 124. Further, in some embodiments, the set of tool-holding means 130 may include at least one pocket 122. The at least two fasteners 124 may each be configured to attach at least one tool from the plurality of tools 130. The at least one pocket 122 may be configured to receive at least one tool from the plurality of tools 130 therein. It should be appreciated that "pocket" is contemplated to encompass any receptacle, slot, pouch, etc. that receives and retains an item therein. The at least one pocket 122 may be integral to the garment-body 112. For example, the at least one pocket 122 may be formed from the garment-body 112. In another embodiment, the at least one pocket 122 may be fastened to the garment-body 112, such as via sewing. As shown, there may be a plurality of pockets attached about the garment-body 112.

A variety of fasteners are contemplated for use with the tool holder 100. For example, the at least two fasteners 124 may include at least one magnet 125, and at least one clip 127. The at least one magnet 125 may preferably be located about the cuff 114, however the at least one magnet may be located on the garment-body 112 or there may be more than one magnet 125 attached about the at least one garment 110. Additional fasteners 124 contemplated may include at least one hook and loop fastener assembly 128 (whereby hook material is attached to either the garment-body 112, the cuff 114, or the at least one tool/at least one tool accessory, and loop material is attached to the other of the garment-body 112, the cuff 114 or the at least one tool/at least one tool accessory to mate the two surfaces together). As shown, the tool holder 100 may include all of the above listed fasteners 124. However, it should be appreciated that the variety of fasteners 124 are not limited to the above listed and illustrated fasteners. For example, in some embodiments the at least two fasteners 124 may include a hook.

As above, the set of tool-holding means 120 may be configured to attach the plurality of tools 130 and the plurality of tool accessories 140 to the garment-body 112 and/or the cuff 114, thus allowing easy access to the plurality of tools 130 and the plurality of tool accessories 140 for the user 10 of the at least one garment 110. The plurality of tools 130 and the plurality of tool accessories 140 may include items that are typically needed by the user 10 when performing a job or activity and are easily misplaced. In some embodiments, at least one of the tools 130 and tool accessories 140 may be selectively attached and detached from the garment-body 112.

The tools 130 and tool accessories 140 may be existing tools 130 and tool accessories 140 already owned by the user 10 and as such, the set of tool-holding means 120 may be sized to attach standard size tools 130 and accessories 140. Alternatively, or in addition to this, the tools 130 and tool accessories 140 may be included in a kit along with the tool holder 100. In this example, the tools 130 and tool accessories 140 may be made custom for the tool holder 100 to ensure they fit properly. In some embodiments, at least one of the tools 130 and tool accessories 140 may be integral to the garment-body 112 and/or the cuff 114. For example, they may be permanently attached to the garment-body 112.

As shown, the plurality of tools 130 may include at least one pencil 131. The at least one pencil 131 may be attached between two digit-receiving sections 115 of the set of digit-receiving sections 115 such that the at least one pencil 131 is useable when attached to the garment-body 112. For example, the at least one pencil 131 may be attached between the middle finger-section and the ring-finger section, allowing the user 10 to quickly locate the at least one pencil 131 and make quick markings.

In some embodiments, the at least one pencil 131 may include two pencils 131. In this embodiment, one of the pencils 131 may be located about the index finger-section of the at least one garment 110. Preferably, one of the pencils 131 may be selectively retractable or extendable. For example, the set of tool-holding means 120 may include a pencil holder 157 having a guide channel 158 configured for receiving the pencil 131 and allowing movement therein between a retracted position and an extended position. When in the extended position, the pencil 131 may be configured for use. The pencil holder 157 may include a lever 159 for the user to grasp and move the pencil 131 into the retracted position or the extended position. Further, in some embodiments, the pencil holder 157 may include a biasing-member, such as a spring (not illustrated), in communication with the lever 159.

The plurality of tools 130 may further include at least one measuring device 132. For example, the at least one measuring device 132 may be a tape measure 152. Further, instead of, or in addition to, the at least one measuring device 132 may include a laser measure device. In addition, the plurality of tools 130 may include at least one light device 133. The at least one light device 133 may include a flashlight 154. In some embodiments, the flashlight 154 may be a goose neck flashlight. As shown, the goose neck flashlight may be attached to a side of the at least one garment 110. Further, instead of, or in addition to this, the at least one light device 133 may include a laser pointer device. As shown, the laser pointer device may be attached between the ring finger-section and the little finger-section such that the user 10 is able to use the laser pointer device without having to remove it from the garment-body 112.

Other tools contemplated may include a set of pliers. The set of pliers may be compact enough to fit on the garment-body. Further, the plurality of tools 130 may include at least one knife 135. In addition, the plurality of tools 130 may include at least one screwdriver. In one embodiment, the screwdriver may be compact and include a handle and tip useable on its own. In another embodiment, the screwdriver may be a bit configured for use with a power drill. The plurality of tool-accessories 140 may include at least one drill bit 144 and at least one screw 134. The at least one screw 134 may be attached to the at least one magnet 125.

As above, the at least one garment 110 may include the pair of garments 117 including the left garment 118 and the right garment 119 which may be used separately or in functional combination. Each of the pair of garments 117 may include the same fasteners 124 located at the same positions on the garment-body 112 and/or the cuff 114 such that the user 10 may utilize the tool holder 100 on their dominant hand. In other embodiments, the pair of garments 117 may include different pocket 122 locations and fasteners 124 for attaching different tools 130 and tool accessories 140 therein. For example, the left garment 118 may attach the laser measure device, the at least one drill bit 144, the at least one knife 135 and the at least one screwdriver and the at least one screw to the garment-body 112; and the right garment 119 may attach the at least one pencil 131, the at least one pair of pliers, the laser pointer device, the tape measure 152, and the flashlight 154 to the garment-body 112.

It should however be appreciated that the pair of garments 117 are not limited to this configuration. It should also be appreciated that the tools 130 and tool accessories 140 are not limited to the means of attachment discussed above. Further, it should also be appreciated that the tool holder 100 is not limited to these tools 130 and tool accessories 140 discussed. In some embodiments, the plurality of tool holders 120 may include beauty tools, art tools, etc.

Figure 7:
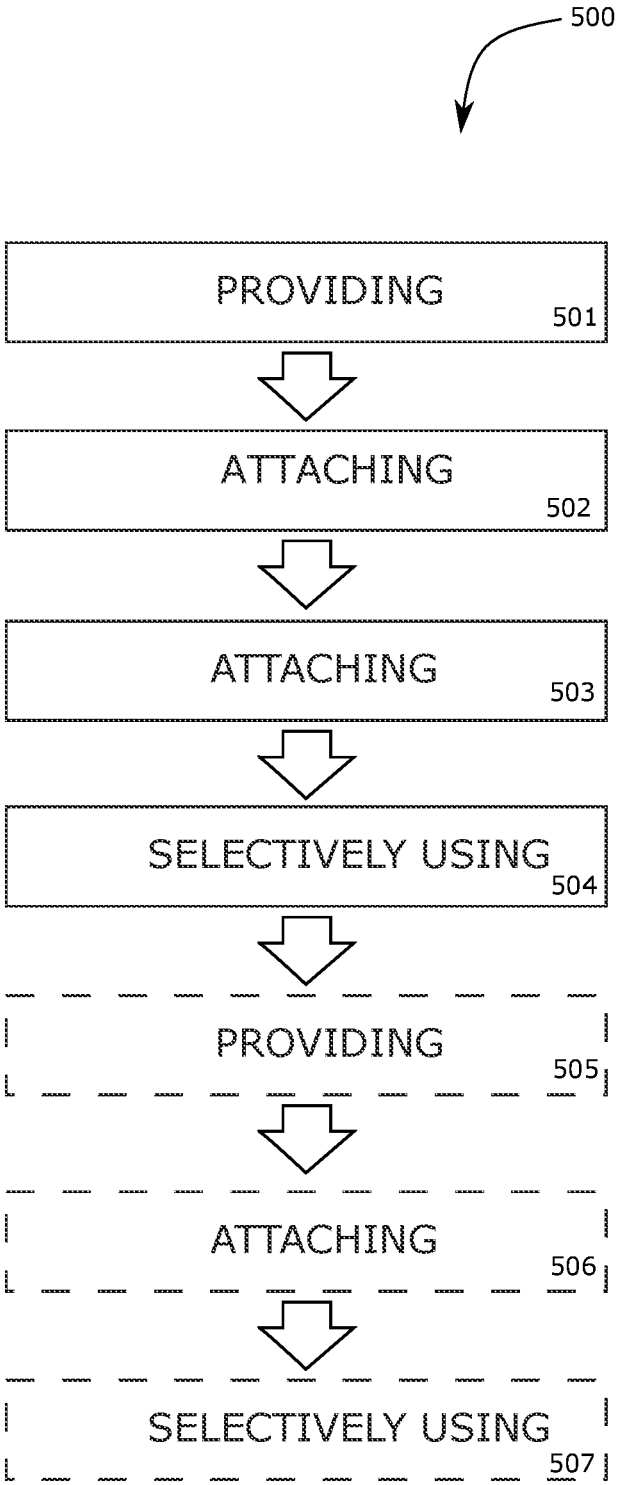
FIG. 7 is a flow diagram illustrating a method of using a tool holder, according to an embodiment of the present disclosure.

Referring now to FIG. 7 showing a flow diagram illustrating a method 500 of using a tool holder, according to an embodiment of the present disclosure. In particular, the method 500 may include one or more components or features of the tool holder 100 as described above. As illustrated, the method 500 may include the steps of: step one 501, providing the tool holder as above; step two 502, attaching the garment-body to the hand of the user and the cuff to the wrist of the user; step three 503, attaching the plurality of tools to said at least one of the garment-body and the cuff via the at least two fasteners; and step four 504 selectively using the plurality of tools. Further steps may include: step five 505, providing the tool holder as above including the set of tool holding-means further configured to attach plurality of tool-accessories to the garment-body; step six 506, attaching the plurality of tool-accessories to said at least one of the garment-body and the cuff via the at least two fasteners; and step seven 507, selectively using the plurality of tool-accessories.

It should be noted that steps five 505, six 506, and seven 507 are optional steps and may not be implemented in all cases. Optional steps of method of use 500 are illustrated using dotted lines in FIG. 5 so as to distinguish them from the other steps of method of use 500. It should also be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for using a tool holder are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A tool holder comprising:

a pair of garments, the pair of garments includes a left garment and a right garment, the left garment having a left garment-body and a left cuff being attached to the left garment body, both the left garment-body and left cuff being configured for wear on a left wrist of the user, the left cuff being attached to the left garment-body, the left garment further including a left rear side relative to the left hand of the user when worn and a left palm side opposite the left rear side and relative to the left hand of the user when worn, the left garment further including a plurality of left pockets located on the left rear side of the left garment-body, each of the plurality of pockets configured to hold one of a plurality of tools, the plurality of tools including at least one pencil, at least one screwdriver, at least one drill bit, the left garment further including at least one left magnet located on the left rear side of the left garment-body, the at least one left magnet configured to magnetically hold at least one screw, the left garment further including a left cuff pocket located on the left cuff, the left cuff pocket configured to hold a knife, and the right garment having a right garment-body and a right cuff being attached to the right garment body, both the right garment-body and right cuff being configured for wear on a right wrist of the user, the right cuff being attached to the right garment-body, the right garment further including a right rear side relative to the right hand of the user when worn and a right palm side opposite the right rear side and relative to the right hand of the user when worn, the right garment further including a plurality of right pockets located on the right rear side of the right garment-body, each of the plurality of pockets configured to hold one of a plurality of tools, the plurality of tools including at least one pencil, at least one screwdriver, at least one drill bit, the right garment further including at least one right magnet located on the right rear side of the right garment-body, the at least one right magnet configured to magnetically hold a measuring tape, the right garment further including a right cuff pocket located on the right cuff, the right cuff pocket configured to hold a tool.

2. The tool holder of claim 1, wherein the right cuff is pivotably-attached to the right garment-body and the left cuff is pivotably-attached to the left garment-body.

* * * * *